US005629583A

United States Patent [19]

Jones et al.

[11] Patent Number: 5,629,583

[45] Date of Patent: May 13, 1997

[54] FLAT PANEL DISPLAY ASSEMBLY COMPRISING PHOTOFORMED SPACER STRUCTURE, AND METHOD OF MAKING THE SAME

[75] Inventors: Gary W. Jones, Raleigh, N.C.; Steven M. Zimmerman, Pleasant Valley, N.Y.

[73] Assignee: Fed Corporation, Hopewell Junction, N.Y.

[21] Appl. No.: 623,124

[22] Filed: Mar. 28, 1996

Related U.S. Application Data

[63] Continuation of Ser. No. 280,355, Jul. 25, 1994, abandoned.

[51] Int. Cl.[6] ..... H01J 1/66

[52] U.S. Cl. ..... 313/495; 313/309; 445/24

[58] Field of Search ..... 313/495, 309; 445/24

[56] References Cited

U.S. PATENT DOCUMENTS

| | | | |
|---|---|---|---|
| 2,926,286 | 2/1960 | Skellett | 345/74 |
| 3,665,241 | 5/1972 | Spindt et al. | 313/351 |
| 3,753,022 | 8/1973 | Fraser, Jr. | 313/78 |
| 3,921,022 | 11/1975 | Levine | 313/309 |
| 3,935,500 | 1/1976 | Oess et al. | 313/495 |
| 3,970,887 | 7/1976 | Smith et al. | 313/309 |
| 3,982,147 | 9/1976 | Redman | 313/309 |
| 3,998,678 | 12/1976 | Fukase et al. | 156/3 |
| 4,008,412 | 2/1977 | Yuito et al. | 313/309 |
| 4,095,133 | 6/1978 | Hoeberechts | 313/336 |
| 4,140,941 | 2/1979 | Uemura | 313/495 |
| 4,227,883 | 10/1980 | Kaplan | 29/571 |
| 4,256,532 | 3/1981 | Magdo et al. | 156/628 |
| 4,307,507 | 12/1981 | Gray et al. | 29/580 |
| 4,325,000 | 4/1982 | Wolfe et al. | 313/336 |
| 4,337,115 | 6/1982 | Ikeda et al. | 156/659.1 |
| 4,341,980 | 7/1982 | Noguchi et al. | 315/169.1 |
| 4,498,952 | 2/1985 | Christensen | 156/643 |
| 4,513,308 | 4/1985 | Greene et al. | 357/55 |
| 4,578,614 | 3/1986 | Gray et al. | 313/309 |
| 4,614,564 | 9/1986 | Sheldon et al. | 156/657 |
| 4,670,090 | 6/1987 | Sheng et al. | 156/653 |
| 4,683,024 | 7/1987 | Miller et al. | 156/643 |
| 4,685,996 | 8/1987 | Busta et al. | 156/628 |
| 4,724,328 | 2/1988 | Lischke | 250/492.2 |
| 4,774,433 | 9/1988 | Ikebe et al. | 313/362.1 |
| 4,824,795 | 4/1989 | Blanchard | 437/62 |
| 4,853,545 | 8/1989 | Rose | 250/396 R |
| 4,900,981 | 2/1990 | Yamazaki et al. | 313/422 |
| 4,964,946 | 10/1990 | Gray et al. | 156/643 |
| 4,990,766 | 2/1991 | Simms et al. | 250/213 |
| 5,030,895 | 7/1991 | Gray | 315/350 |
| 5,053,673 | 10/1991 | Tomii et al. | 313/308 |
| 5,063,327 | 11/1991 | Brodie et al. | 313/482 |
| 5,129,850 | 7/1992 | Kane et al. | 445/24 |
| 5,140,219 | 8/1992 | Kane | 313/495 |
| 5,141,459 | 8/1992 | Zimmerman | 445/24 |
| 5,141,460 | 8/1992 | Jaskie et al. | 445/24 |
| 5,188,977 | 2/1993 | Stengl et al. | 437/89 |
| 5,191,217 | 3/1993 | Kane et al. | 250/423 |
| 5,199,917 | 4/1993 | MacDonald et al. | 445/24 |
| 5,205,770 | 4/1993 | Lowrey et al. | 445/24 |
| 5,216,324 | 6/1993 | Curtin | 313/495 |
| 5,371,431 | 12/1994 | Jones et al. | 313/309 |
| 5,371,433 | 12/1994 | Horne et al. | 313/495 |
| 5,386,175 | 1/1995 | Van Gorkom et al. | 313/422 |
| 5,404,070 | 4/1995 | Tsai et al. | 313/336 |
| 5,406,170 | 4/1995 | Uemura et al. | 313/495 |
| 5,457,356 | 10/1995 | Parodos | 313/505 |

FOREIGN PATENT DOCUMENTS

| | | | |
|---|---|---|---|
| 58-94741A | 6/1983 | Japan | H01J 27/02 |

*Primary Examiner*—Alvin E. Oberley
*Assistant Examiner*—Lawrence O. Richardson
*Attorney, Agent, or Firm*—Collier, Shannon, Rill & Scott PLLC

[57] ABSTRACT

A spacer structure for use in a flat panel display, and a corresponding flat panel display article are disclosed, together with an appertaining method of fabricating the spacer structure utilizing a photosensitive precursor material which is selectively irradiated, developed and etchingly processed to produce shaped standoff elements for a unitary spacer structure. The spacer structure may be dimensionally fabricated to precisely align with a selected pixel region, comprising a single pixel or an array of pixels, e.g., a color (red, blue, green) triad.

10 Claims, 4 Drawing Sheets

Fig. 7
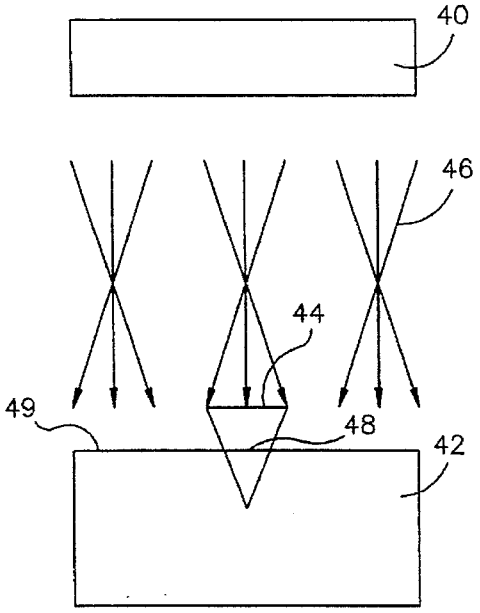
Fig. 9
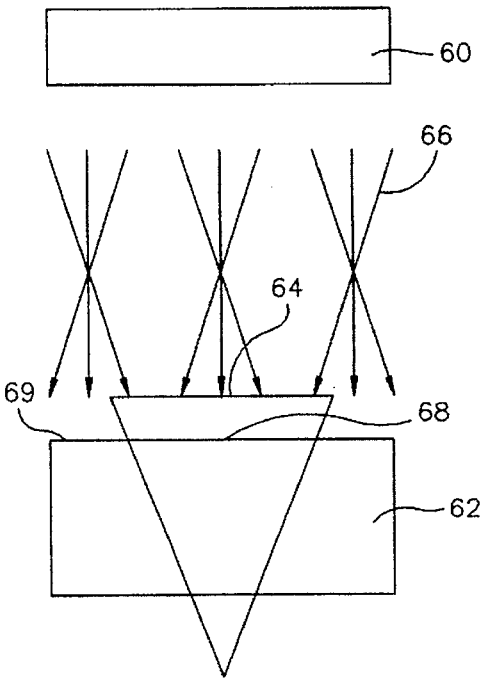
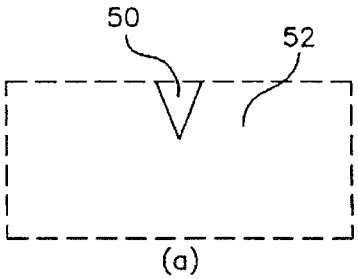
Fig. 8
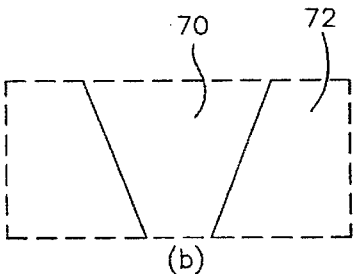
Fig. 10

FLAT PANEL DISPLAY ASSEMBLY COMPRISING PHOTOFORMED SPACER STRUCTURE, AND METHOD OF MAKING THE SAME

This is a continuation of U.S. application Ser. No. 08/280,355 filed Jul. 25, 1994, now abandoned.

BACKGROUND OF THE INVENTION

1. Field of the Invention

This invention relates generally to flat panel displays comprising spaced-apart anode and field emitter plates, and more particularly to a flat panel display assembly of such type utilizing novel spacer means.

2. Description of the Related Art

In the use of field emitter technology, a wide variety of flat panel display assemblies have been proposed by the prior art. In general, these display assemblies comprise spaced-apart cathode (emitter) and anode plates, wherein the emitter plate comprises a multiplicity of field emission elements which produce electron beams which are transmitted to the anode display plate, which may for example comprise an array of phosphor elements or other luminescent materials or members, which are luminescently responsive to the impingement of electrons thereon.

In the manufacturing of flat panel display assemblies of the above-discussed type, the respective emitter and anode plates must be readily fabricated in spaced-apart relationship to one another, and a variety of spacer means and methods have been proposed in the prior art to effectuate the required spaced-structural relationship between the plates.

More specifically, the spacer structure is a critical element in the development of large-area reduced-pressure flat panel displays, which is a practical obstacle to the convergence of other aspects of display technology, such as emitter sources and phosphors. The use of displays in a wide spectrum of applications, including defense, scientific, medical, educational, business and recreational usages, has proliferated, and yet the potential for additional applications and refinement in the conventional technology is substantial. With the proliferation of devices such as portable work stations, lap tops, palm tops, pen-based pads, video phones, cellular phones, digital high definition television (HDTV), etc., and the proliferation of world-wide multimedia networks and satellite direct access capabilities, the volume of available cyberspace information is staggering in amount, and the visual display appears to be the only device which is effectively poised to communicate in a quick and efficient manner the vast amount of available information to users thereof.

Concerning specific application areas of flat panel displays, applications such as portable equipment and miniaturized microelectronic devices require extremely small volume to viewing area ratios, which more generally are desirable in a wide variety of other applications. Lap top, notebook and pen-based computer devices require flat panel displays to constitute commercially viable devices. The current promise of digital HDTV may never be realized in many households if it demands space for a 100 cubic foot cathode ray tube (CRT) or rear-projection based monitor. A truly functional and affordable flat panel display technology is likely to displace virtually every other form of two-dimensional display, including those used in stereo pair generation for 3-D viewing.

Despite its promise, many alternative technologies including liquid crystal displays (LCD's), active matrix liquid crystal displays (AMLCD's), plasma displays, electroluminescent displays and vacuum fluorescent displays have been utilized as commercial alternatives to flat panels, but all of these alternative display devices fall far short of providing an optimum flat panel implementation. Major issues such as cost, power efficiency, viewing angle, brightness, and color purity diminish their utility; nonetheless, the demand for flat panel functionality is sufficiently great so that such serious limitations currently not only are tolerated, but successfully compete with traditional display technology.

Field emitter array (FEA) displays provide a new display technology that is at least theoretically capable of meeting all of the requirements for a general purpose flat panel display. Advantages of FEA display technology include thinness of the panel (no bulky CRT tube and yoke, or back light, is required), low weight characteristics, wide viewing angle capability, wide range of color viewing capacity, high efficiency (direct light generation, cold cathode electron source means), high brightness, high resolution, very fast response time, wide dynamic range (from night levels to direct sunlight visibility), wide temperature range operating capability, instant turn-on character, back site component mounting ability, and reduced cost (being less expensive and much simpler in structure than the AMLCD).

Although the art has directed considerable effort to basic structures, materials, and manufacturing processes necessary to produce emitters for display purposes, unfortunately the critical spacer structure has not received a significant amount of attention.

Display structures using field emitters require a sufficient distance between the emitter (cathode) and the phosphor plate (anode) to isolate high anode voltages used to achieve the most efficient excitation of the light-generating phosphors. Spacing dimensions on the order of from about 0.5 mm to about 1.5 mm are typical. These spacing dimensions, while seemingly small, are in fact very large compared to the mean free path of electrons in atmospheric pressure gases between the respective cathode and anode plates. As a result, the spacing between plates must be evacuated to the pressure levels found in typical CRT's. Other flat panel display technologies also require partial (plasma displays) or comparable (vacuum fluorescent displays) levels of evacuation. Evacuation of the space between the cathode and anode plates places a one atmosphere (760 mm) static load on the plates and produces a plate deflection that is dependent on the area, strength and thickness of the material of construction of the plate, typically glass. Excessive deflection may seriously adversely affect the operating characteristics of the flat panel display, in such respects as pixel size, uniformity of brightness, and may increase the risk of anode to grid or cathode arcing. For small displays, such deflection is not a problem of significant character, due to the dimensions involved. Typical glass thicknesses of 2–3 mm may be used in perimeter-supported displays of up to 50 mm and potentially higher dimensions, but for larger area display articles, the corresponding need to increase plate thickness to accommodate such pressure levels would substantially add to the thickness and weight characteristics of the overall display and is not considered acceptable or desirable for commercial and aesthetic reasons. Accordingly, for larger area displays, internal spacer means are necessary to prevent undue deflection with the consequent adverse effects on operability, it being recognized that excessive pressure deflection in the absence of suitable spacer (support) means in the interior volume of the flat panel display article may result in rupturing of the evacuated plate and loss of its utility for its intended purpose.

The plate spacer structure introduces a number of structural and design complexities to the fabrication of the flat panel display article. The spacer structure must be strong enough to support the static pressure load, as well as any additional dynamic load resulting from handling, assembly, and use of the display. Further, the spacer structure must be fabricated to fit between pixels or pixel arrays (e.g., triads of color sub-pixels). The spacer structure further must stand off (insulate) the high anode potential. The spacer structure additionally must provide a continuous open pathway parallel to the plates to allow both initial evacuation of the display panel article, and long-term gettering of slowly released gas contaminants (off-gassing in situ in the interior volume of the display panel).

From a design standpoint, the spacer structure must permit alignment to the emitter (cathode) pixel structures, as well as to the anode plates phosphor color patterns in color display articles. The spacer structure must also be cost-effective in fabrication and assembly.

The foregoing requirements present a great challenge in the development of commercially acceptable, mass-producible flat panel display articles that are field emitter-based, and provide medium to large area display capability.

Currently practiced spacing means and methods have associated severe shortcomings. One field emitter display article prototype devised by LETI in France, utilizes glass spheres which are adhered to the emitter plates with a screened-on organic adhesive medium. The spherical spacer elements are undesirable because their aspect ratio (1:1) do not satisfy the requirements of higher resolution displays and their shape increases the potential for arcing between the anode and the grid or emitters. Organic adhesives also are undesirable because of the associated high temperature sealing conditions required, evacuation bake requirements during pump-out, long-term outgassing loads in the small volume static vacuum space, and because the low dielectric constant of the organic adhesive at the interface promotes splash-over.

The use of cured photosensitive polyimide spacer blocks formed directly on the emitter plate from 100 micrometer-thick films has been proposed. This technique also is severely limited in aspect ratio-characteristics, and long-term outgassing properties of the polyimide material in small high vacuum assemblies has not been demonstrated.

Other plasma displays have been produced using tall, vertically-standing metal wire segment spacers. The insulated AC operation of these panels allows the use of these metal spacers which are individually placed on an adhesive material, in a standing position, but they are unacceptable for field emitter displays. The maintenance of spacers in a precise vertical position during the fabrication operation is a difficult and yield-limiting task. Although contamination is less of a problem in plasma display applications which work in a moderate pressure gas environment, the contamination associated with the use of such adhesive material with the metal spacers is highly undesirable in field emitter-based panel article applications.

Accordingly, none of the aforementioned conventional spacer techniques satisfies the requirements of high performance vacuum panel displays.

It therefore is an object of the present invention to provide a means and method of spacing emitter and anode plates in a field emitter-based flat panel display assembly, which overcomes the aforementioned various disadvantages of the prior art spacer means and methods.

It is another object of the present invention to provide such improved spacer means and method, which are effectively utilized in large area display panel applications.

It is a further object of the present invention to provide such improved spacer means and method which are non-deleterious to the pixel arrangement and operation of the display panel.

Other objects and advantages of the present invention will be more fully apparent from the ensuing disclosure and appended claims.

SUMMARY OF THE INVENTION

In one aspect, the present invention relates to a display panel comprising an anode plate, an electron source plate comprising an array of field emitter elements defining with the anode plate pixels of the display panel, with the anode plate and electron source plate being maintained in spaced relationship to one another by spacing means comprising a unitary spacer structure comprising photoformed spacer elements joined to a support structure and interposed in bearing and supporting relationship between said anode and electron source plates. As used herein, the term "photoform" means that a material is formed by irradiation of a precursor workpiece and then processed to form a structural member or component.

The photoformed spacer elements preferably are constructed and arranged in arrays to circumscribingly bound a pixel region, e.g., comprising a single pixel, or an array of pixels.

The spacer structure may suitably comprise a support matrix of perpendicularly arranged arrays of elements forming a grid-structure having the spacer elements joined thereto.

Preferably, the spacer elements in the spacer structure comprise columnar elements extending upwardly from the grid support structure.

The unitary spacer structure advantageously is formed, developed, and etched to yield an array of vertically upwardly extending spacer elements extending from and integral with a support grid structure having the spacer elements arranged to bound openings accommodating positioning in relation to pixel regions for throughput of electrons from the electron source plate through the spacer structure to the anode plate.

The unitary spacer structure for example may be formed of a developed and etched glass material comprising the photoformed spacer elements.

Correspondingly, the anode plate may comprise an anode plate substrate metalized with a reflective/conductive metal anode layer of patterned character defining non-metalized openings surounded by metalized regions of the metalized anode layer, wherein the spacer elements are aligned with the non-metalized openings in the metalized anode layer.

In another aspect, the present invention relates to a method of making a display panel comprising an anode plate, an electron source plate including an array of field emitter elements, and a spacer structure including a plurality of spacer elements, interposed between the anode and electron source plates, comprising the steps of:

providing a photosensitive material workpiece as a precursor structure of at least a portion of the spacer structure comprising the spacer elements;

exposing a surface of the photosensitive material workpiece to photosensitizingly effective radiation for sufficient time and at sufficient intensity to photosensitize selected portions of the photosensitive material workpiece;

removing non-photoexposed material from said workpiece to yield at least a portion of the spacer structure including a plurality of spacer elements; and interposing the spacer structure between the anode and electron source plates, such that the anode and electron source plates are maintained in spaced-apart relationship to one another by the spacer structure.

Other aspects, features, and embodiments of the invention will be more fully apparent from the ensuing disclosure and appended claims.

BRIEF DESCRIPTION OF THE DRAWINGS

FIG. 7 is a schematic illustration of a process system for photo developing a photosensitive material to form a conical mask region in a substrate.

FIG. 8 is a schematic depiction of the conical element formed from the irradiated substrate shown in FIG. 7, subsequent to etch removal of photoexposed portions of the substrate.

FIG. 9 is a schematic illustration of a process system for irradiating a photosensitive substrate, to produce a masked inverted frustoconical region.

FIG. 10 is a schematic depiction of an inverted frustoconical structural element formed by etch removal of irradiated portions of the substrate of FIG. 9.

DETAILED DESCRIPTION OF THE INVENTION AND PREFERRED EMBODIMENTS THEREOF

The present invention utilizes photosensitive materials such as glasses, polymers, etc. that can be irradiated, thermally developed, and chemically etched into complex patterns. The photosensitive material may for example comprise a photosensitive glass, ceramic, glass-ceramic material, or polymeric material of suitable character. Advantageous glass and ceramic (glass-ceramic) materials suitable for usage include the materials commercially available from Corning, Inc. under the trademarks FOTOFORM® and FOTOCERAM®. A particularly preferred illustrative material of such type is Fotoform® UV-sensitive glass (Corning, Inc., Corning, N.Y.). Such material can provide aspect ratios of up to 40:1 (aspect ratios as used herein referring to the length or longitudinal dimension of a structure, relative to its width or transverse dimension), as well as high quality insulating properties and amenability to forming multilevel structures allowing transverse pathways. Although such materials have inherent potential application to use in spacer structures, the prior art has not seriously considered same for flat panel display fabrication because of their excessive cost and limited size (for example, the aforementioned Fotoform glass is currently available only in 7×7 inch maximum sizes.

Accordingly, the present invention utilizes such radiation-alterable materials in a novel spacer structure which beneficially utilizes the desirable aspects of materials such as the aforementioned photoformable glass materials, while overcoming their limitations of size and cost.

Figure 1:
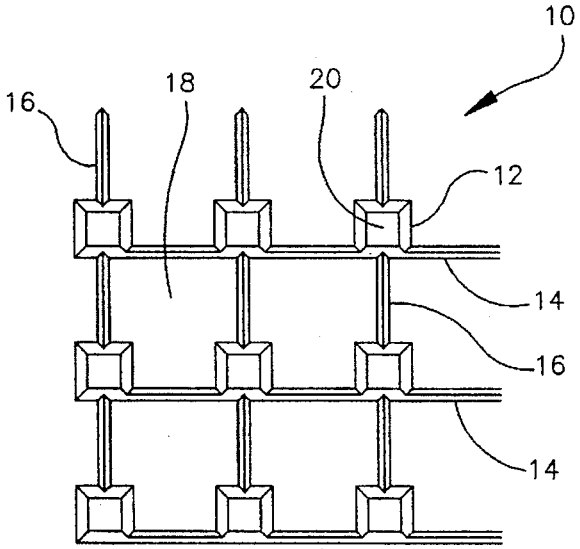
FIG. 1 is a top plan view of a spacer structure according to one embodiment of the present invention.

Accordingly, in a preferred aspect, the present invention contemplates the use of relatively small, discreet spacer members, such as is shown in FIG. 1.

FIG. 1 is a top plan view of a spacer structure 10 in which such spacer member comprises a regular array of standoffs 12, which are vertically upwardly extending elements having upper bearing services 20 for abutting supportive contact with a plate member of a display panel, or such contact with a corresponding opposedly facing spacer structure (i.e., wherein respective facing spacer structures are mated in abutted contact with one another, with for example, one spacer structure being associated with the emitter (cathode) plate of the display panel, and the other spacer structure being associated with the anode plate of the display article).

The standoffs 12 in this embodiment are of truncated pyramidal shape. It will be recognized that the standoff elements of the support structure may be of any suitable shape or geometry, as necessary or desirable in a given end use application.

The standoff elements 20 are interconnected in a matrix structure by means of the horizontal support members 14 and the vertical support members 16 (such horizontal and vertical directions referring to the orientation of the spacer structure as shown in FIG. 1), it being recognized that the shape of these members and their orientations may be widely varied within the broad practice of the present invention; in general, however, perpendicular and rectangular (square) relationships between the members are desirable, for ease of alignment and orientation relative to the pixels defined by the emitter and anode plates, as hereinafter more fully described.

The standoff elements 20 and the support members 14 and 16 may be integrally formed from a single block or other form of precursor material. Alternatively, the standoff elements 20 may be separately formed and affixed or secured to the grid or matrix formed by support members 14 and 16. In any event, the standoff elements and support members cooperatively form a unitary support structure which is interposable between plates or other structural portions of a display panel to contribute strength and mechanical integrity to the display article, and to permit the display to be evacuated to low vacuum levels, without undue static load or, in use, dynamic load deficiencies in the structure and operation of the display panel article.

Figure 2:
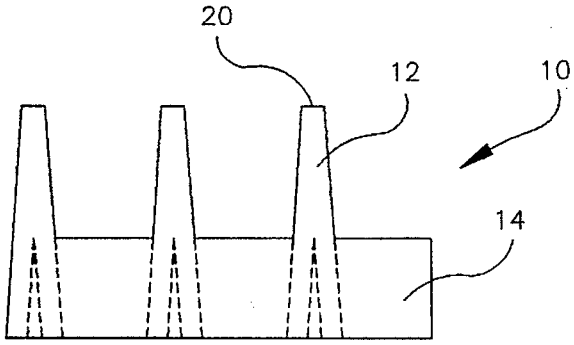
FIG. 2 is a front elevation view of the FIG. 1 spacer structure.
Figure 3:
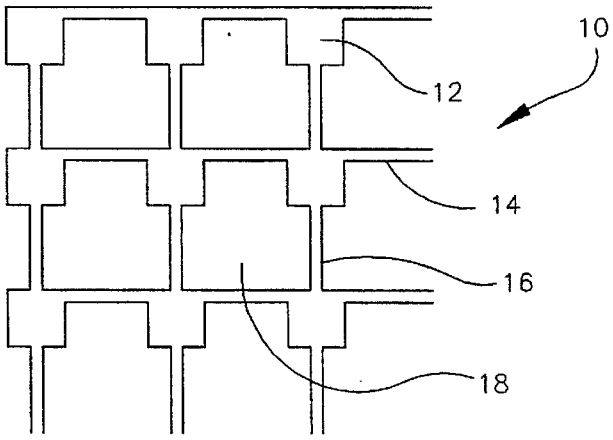
FIG. 3 is a bottom plan view of the spacer structure of FIG. 1.

FIG. 2 is an elevation view of the spacer structure 10, and FIG. 3 is a bottom plan view of such spacer structure, wherein all parts and features of the structure are correspondingly numbered with respect to FIG. 1.

The number of "cells" or repeating units in a spacer structure such as is shown in FIG. 1 (such cells referring to the portion of the structure surrounding a given open area 18 in the structure) will be determined by the material and construction, its strength and the frequency of placement (i.e., number of spacer segments per unit area of the display panel). These spacer structure segments can be individually placed at an appropriate density across display panels of very large size.

In practice, the spacer structure segments of the type shown in FIGS. 1–3 may be interposed between respective emitter and anode plates of the display article, in continuous fashion with the spacer segments being contiguous to one another across the full areal extent of the display panel. Alternatively, the spacer segments may be disposed in spaced-apart relationship to one another across such areal extent of the display panel interior volume. The specific arrangement, spacing, size of the spacer segment, and frequency may be readily determined without undue experimentation by those of ordinary skill in the art, based on determinations of static and dynamic loads, and deflection levels of the plates utilized in a given display panel, with and without support by the spacer structure.

Figure 4:
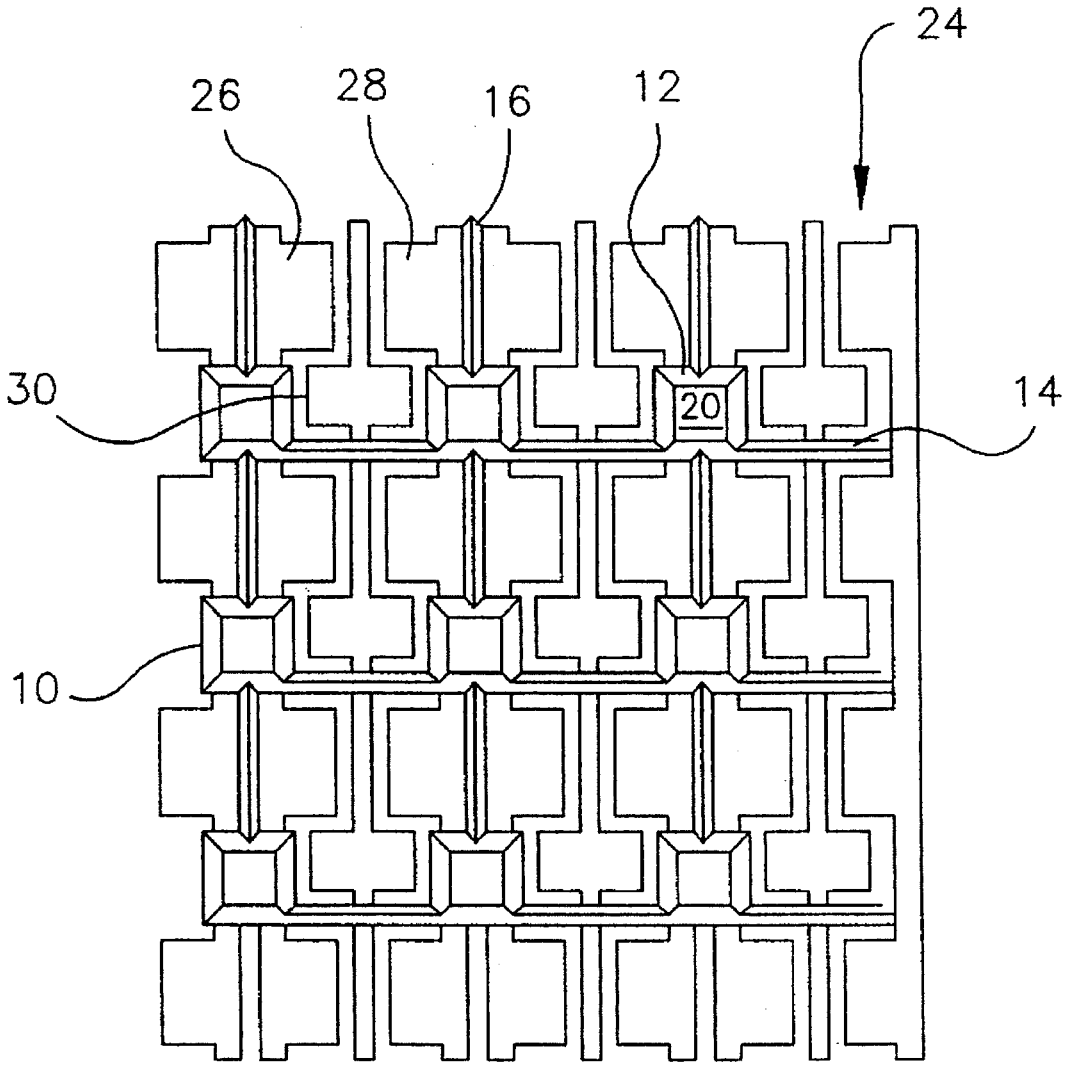
FIG. 4 is a top plan view of a portion of a field emitter flat panel display assembly, comprising a spacer structure according to one embodiment of the present invention, of the type shown in FIG. 1, shown superposed on a field emitter color triad array.

FIG. 4 is a top plan view of the spacer structure 10 shown in FIGS. 1–3 (and whose component elements are correspondingly numbered with respect to FIGS. 1–3) positioned on a matching field emitter color triad array comprising a multiplicity of red color elements 26, green color elements 28, and blue color elements 30, each of said color element triplets (red, green, blue) constituting a pixel of the overall array.

This FIG. 4 embodiment illustrates the manner in which spacer dimensions can be maximized and aspect ratios of the support structure reduced by the arrangement of the emitter color sub-fields within the pixel. The need to stand up an individual high aspect ratio spacer element is eliminated by making the spacer structure segment large enough to cover many pixels, thereby making the aspect ratio of the spacer structure segment relatively small. The spacer structure segment is readily handled and requires no greater alignment control than any other discreetly positioned element utilized in the display article.

The fine resolution and high aspect ratio capability of the preferred photoformable glass material allows the creation of an open structure for both electron passage and lateral gas evacuation within the support structure segment. Concerns about matching of coefficients of expansion are also minimized, since any expansion mismatch is accumulated over only the length of the spacer structure segment and not over the entire length of the display article. The clusters of supports in the spacer structure segment provide greater bearing and racking strength than do isolated individually placed spacer elements, and afford the potential for greatly reducing the number of spacer elements requiring placement in the interior volume of the display panel, as determined on a unit area of display basis.

The provision of the spacer structure segment of the type illustratively described hereinabove likewise serves to minimize costs. The small size of the spacer structure segment allows hundreds or even thousands of segments to be fabricated from a plate of precursor (raw) material. The design and divergent exposure process hereinafter more fully described allows complex three-dimensional structures of the spacer structure segment to be fabricated with a single exposure which eliminates mask alignments and reduces both processing and mask costs.

Further, the repetitive pattern of the spacer structure segment allows many types of damaged segments (standoff elements) such as those with missing corners, to be employed as long as the remaining spacer structure meets minimum load requirements. Thus, the spacer structure segment tolerates mechanical imperfection in the standoff elements and enhances the yield character of the fabrication process, particularly in the instance where the standoff elements are subjected to impact, abrasion, and other forces incident to manufacture and handling which may result in localized imperfections in the bearing surfaces of the standoff elements.

The spacer structure of the present invention also has benefits in respect of flashover (arcing) control. Flashover control is of special concern in the fabrication and operation of flat panel field emitter displays because the small spacings characteristic of the structure encourage its occurrence. As a countervailing consideration, it is desirable to use as high an anode potential as possible, in order to improve efficiency and brightness, beyond the levels achievable at larger spacing dimensions. The spacer structures of the present invention are amenable to application of coatings to selected surfaces or portions thereof which enhance high voltage operation while reducing the tendency of the spacer structure to flashover.

Maximum anode potential in operation of the flat panel display is principally governed by the tendency of charge to suddenly and violently travel across the spacer surface, as the aforementioned flashover phenomenon. Flashover generally occurs when the surface charge on the spacer is contiguous enough to form an initiating conductive pathway rather than as a result of the spacer structure's bulk insulator properties or defects. The maximum potential therefore is generally defined by the absence of flashover. Surface treatments may be employed to minimize surface charge while electron bombardment (due to normal operation) generally reduces the maximum potential by increasing surface charge.

Figure 5:
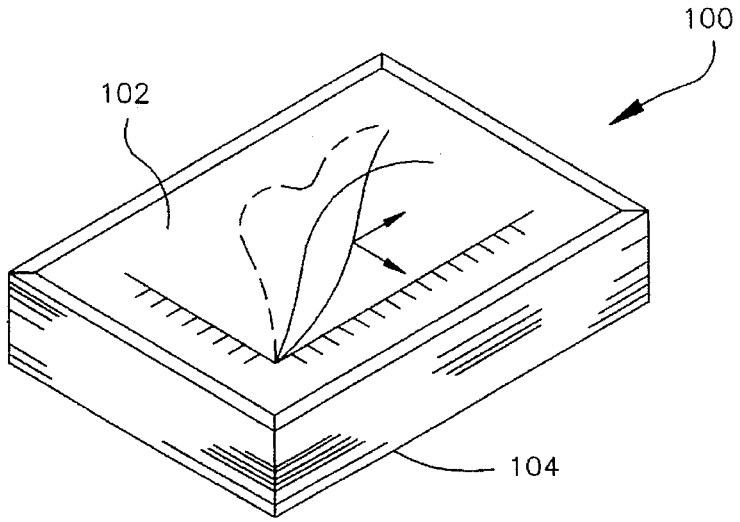
FIG. 5 is a perspective view of a flat panel display assembly according to one embodiment of the present invention, and featuring spacer structure in accordance with the invention in an exemplary embodiment thereof.

FIG. 5 is a perspective view of a flat panel display 100 comprising spaced-apart anode plate 102 and cathode plate 104, of a general type in which the spacer structure of the present invention may advantageously be employed.

Figure 6:
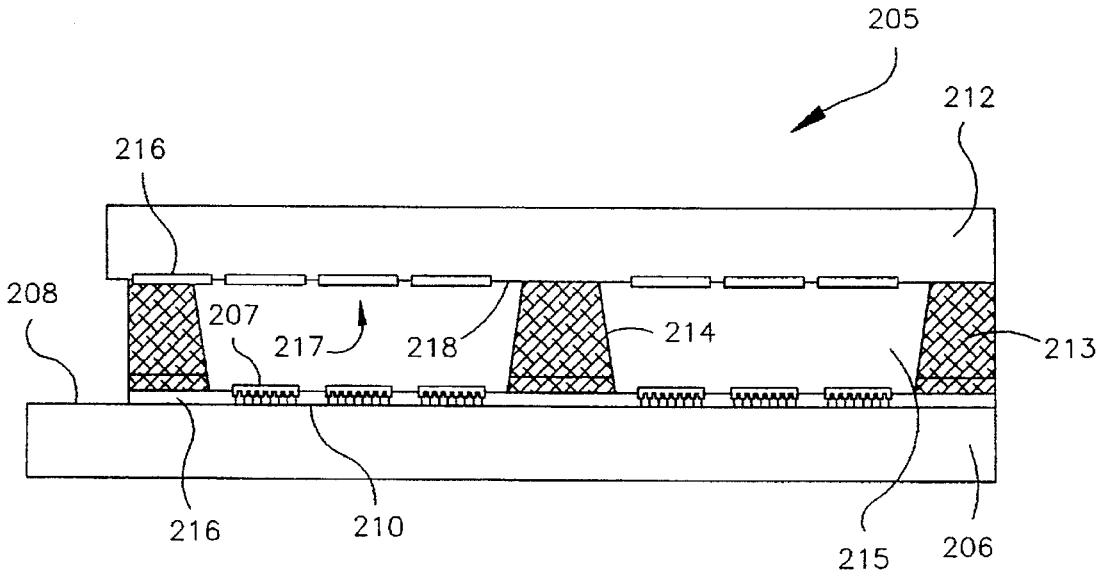
FIG. 6 is a sectional elevation view of a portion of a flat panel display assembly according to FIG. 5, showing the component structure thereof including the emitter and anode plates and spacer structure.

FIG. 6 is a sectional elevation view of a flat panel display according to one embodiment of the invention. The display panel 205 comprises a bottom plate 206 which may be formed of glass or other suitable material, on the top surface which is provided a series of emitters 207, wherein the emitter connections are oriented perpendicular to the plane of the drawing page. The emitters 207 are provided with gate row connections 208, and gate lines 210. The emitters are constructed over a vertically conducting resistor layer on the substrate. The panel 205 comprises a top plate 212 of a suitable material such as glass. The top plate is maintained in spaced relationship to the bottom plate by means of spacer elements 213, which feature a flashover control coating 214 on their surfaces exposed to vacuum space 215.

The spacers at the sides of the display may be sealed to the associated plates by means of frits 216, which may for example comprise silica as their material of construction. The top plate 212 may be coated on its lower surface with a black matrix material, such as a mixture of barium and titanium, and the RGB phosphors 217 are disposed on the top plate against the black matrix material 218. The RGB phosphors may optionally be coated with a thin aluminum coating, and may be provided with an ITO underlayer.

The emitters shown in the panel arrangement of FIG. 6 may alternatively be organized in monochrome displays, light panels, sequenceable light strips, and other configurations.

FIGS. 7–10 illustrate the fabrication of a spacer structure according to a preferred embodiment of the invention.

As shown in FIG. 7, a divergent light source 40 is arranged in light transmission relationship to precursor block 42 formed of a photosensitive material, such as the aforementioned Fotoform glass commercially available from Corning, Inc. (Corning, N.Y.). The light source 40 is selected to emit divergent light beams 46 of a selected suitable wavelength and intensity. The upper (impingement)

surface of the precursor block 42 is masked over a selected area 48 by means of masked element 44.

By such arrangement, the divergent radiation 46 is impinged on surface 49 and into the interior of the precursor block glass material 42. The mask 44 is disposed in relation to the divergent radiation 46 so that the surface region 48 is masked and the radiation path correspondingly forms an unexposed 42 conical portion of the precursor block 42, with the remainder of the block being photoexposed. Thus, the divergent light source produces a controlled degree of exposure under the mask which is dependent on the distance from the mask or the image plane in the case of projection printing. When mask features are narrow in dimensions, the light from both sides of the mask crosses within the body of the material, and when developed and etched, results in an intermediate height feature. The edges of larger mask features do not meet within the body of the precursor block material and therefore result in full height features. In spacer structure segments, height control in the intermediate structures is non-critical.

The photoexposed precursor block 42 then is baked and flood exposed to a suitable etchant for the material construction of the precursor block. In such manner, the photoexposed portion 52 of the block as shown in FIG. 8 is etchingly removed, yielding the conical-shaped element 50 as a shortened structure in relation to the height or thickness dimension of the precursor block.

FIGS. 9 and 10 show an analogous process, utilizing a wider mask, to produce a truncated inverted conical shape from the precursor block. In FIG. 9, the divergent light source 60 is shown as producing divergent light beams 66 which impinge on the surface 69 which is partially masked by mask element 64 to provide an unexposed surface portion 68 on the precursor block 62. The photoexposure is conducted to completion. The precursor block after photoexposure then is baked at suitable elevated temperature to develop the photoexposed portions of the precursor block, following which the block is subjected to flood exposure of suitable etchant. The etching removes portion 72 of the precursor block as shown in FIG. 10 (wherein the dashed outline denotes the original bounding surfaces of the precursor block 62 (See FIG. 9)), yielding the inverted frustoconical shape of the standoff element 70.

In general, a wide variety of photosensitive materials may be utilized in the production of spacer structures in accordance with the present invention. In the typical process flow, the photosensitive material exposed to suitable radiation, e.g., visible or collimated UV light, while selected areas of the photosensitive material workpiece are masked. The photoexposed image then is developed, typically under elevated temperature or other development conditions, followed by optional further development steps including flood exposure in which clear areas of the previously irradiated workpiece are exposed to uncollimated UV or other radiation without a mask, followed by etch or other removal of the non-masked areas of the workpiece. For example, in the case of a photosensitive glass material, the unmasked areas of the workpiece may be dissolved in a suitable etchant or reagent medium, such as dilute hydrofluoric acid. Finally, the resulting structural article may be subjected to selected post-treatment operations such as ceramicization and/or heat treatment.

Comparison of FIGS. 8 and 10 shows that the size and shape of the support structure elements may be widely varied by the simple expedient of varying mask size with respect to the resultingly produced shaped member. The technique illustratively described with reference to FIGS. 7–10 may be employed to produce discreet standoff elements which, as previously described, can be structurally coupled to or secured to other structural elements, e.g., the grid-like matrix of the support structure 10 shown in FIGS. 1–4. Alternatively, the precursor block utilized to form the standoff elements may be selectively irradiated by suitable masking members to produce a unitary, integral support structure, such as the unitary support structure segment shown in FIGS. 1–4 hereof.

The anode plate of the flat panel display article of the present invention may be formed and constructed in any suitable manner, within the skill of the art. In a preferred aspect, such anode plate may be aluminized with a reflective/conductive aluminum anode layer on the surface of a plate of suitable material construction, such as glass. This reflective/conductive aluminum anode layer may suitably be patterned so as to minimize the electric field directly across the spacer structure and to provide an anode connection point. The patterning comprises aluminized regions on the anode plate substrate member, and non-aluminized openings defined by the circumscribing aluminized regions. The non-aluminized openings pass and trap incident light more effectively than a black matrix, thereby improving sunlight readability of the flat panel display (although a black matrix coating such as titanium or carbon may still be used with such patterned aluminized layer). Such patterned aluminizing of the anode substrate member also reduces the potential for contamination of the interior volume of the flat panel display as a result of the spacer structure projections crushing particles or films on the anode surface, or otherwise removing particulate or otherwise removing particulate or finely divided metal or other material which can severely adversely affect the operability of the flat panel display article.

The spacer structure of the present invention may be utilized with surface coatings of various suitable types, which may for example provide enhanced structural or mechanical integrity to the spacer structure or otherwise improve its operating (electrical) properties. For example, surface coatings on the spacer structure of slightly leaky insulators may be used to control charging and surface charge accumulation. Examples of such surface coatings include aluminum silicate, alumina, and boron. In such respect, photosensitive glasses such as the Fotoform™ glass may have very effective surface leakage characteristics per se as suitable for various applications.

It will be recognized that the photoforming process may be widely varied, as regards the precursor block materials of construction, radiation intensity and wavelength characteristics, coherency characteristics of the radiation, use of other than visible light radiation, e.g., ultraviolet or other actinic radiation, variation in mask size, shape and placement, variation in development (e.g., baking conditions) subsequent to initial radiation exposure, and variation in etching reagents and etch conditions, etching here being broadly construed to include any solublization process by means of which material is removed from a precursor workpiece subsequent to radiation exposure and development.

As an alternative to etching removal of material from photodeveloped workpieces, it is within the purview of the present invention to utilize non-etching removal techniques, including mechanical removal processes and procedures, either for bulk removal of material, or for finishing of rough-formed support structures.

In respect of electrical characterization and optimization of support structures within the broad purview of the present invention, the testing and optimization may be carried out in a manner within the skill of the art. For example, electrical testing may be carried out by placement of spacer structures between conductive surfaces onto plates, with the imposition of a variable potential difference across the spacer structure. Leakage occurrence then can be measured together with the occurrence and frequency of flashover events. The cathode plate may in such testing comprise a field emitter array, positioned relative to the spacer structure so that pixels in known positions may be selectively activated, for purposes of measurement while the activated pixels are conducting. By use of different pitches for pixel and spacer components, pixels with different proximities to the spacer structure can be activated without breaking vacuum conditions, or otherwise changing empirical conditions, to thereby test the spacer structure's sensitivity to pixel alignment.

While the invention has been illustratively described with respect to specific preferred features, aspects, and embodiments, it will be recognized that the invention may be widely varied, and that numerous other variations, modifications and alternative embodiments are possible, within the spirit and scope of the present invention.

What is claimed is:

1. A display panel comprising:

an anode plate;

an electron source plate comprising an array of field emitter elements; and spacing means for maintaining said anode plate and electron source plate in spaced relationship to one another, said spacing means comprising a planar matrix support structure of intersecting elongate members, which define a plurality of individual cells therebetween, said matrix support structure being formed as a unitary spacer structure having photoformed spacer elements integrally joined perpendicularly to the planar support structure at points of intersection of the intersecting elongate members and interposed in bearing and supporting relationship between said anode and electron source plates, said individual cells defining pixel regions of the display screen.

2. A display panel according to claim 1, wherein said photoformed spacer elements are and arranged at each of said points of intersection of the intersecting elongate members to circumscribingly bound each of the individual cells.

3. A display panel according to claim 2, wherein said pixel region comprises a single pixel.

4. A display panel according to claim 2, wherein said pixel region comprises an array of pixels.

5. A display panel according to claim 1, wherein the intersecting elongate members are perpendicularly arranged forming a grid-structure having the spacer elements joined at the intersections thereof.

6. A display panel according to claim 5, wherein the spacer elements in said spacer structure comprise columnar elements extending upwardly from the grid support structure.

7. A display panel according to claim 1, wherein the intersecting elongate members and photoformed spacer elements of said spacing means are formed, developed, and etched from a unitary block of photoformable material to yield a support grid structure having spacer elements which bound openings which define the pixel regions for throughput of electrons from the electron source plate through the spacing means to the anode plate.

8. A display panel according to claim 1, wherein the unitary spacer structure is formed of a developed and etched glass material comprising said photoformed spacer elements.

9. A display panel according to claim 1, wherein the anode plate comprises an anode plate substrate metalized with a reflective/conductive metal anode layer of patterned character defining non-metalized openings surounded by metalized regions of the metalized anode layer, wherein the spacer elements are aligned with the non-metalized openings in the metalized anode layer.

10. A display panel comprising:

an anode plate:

an electron source plate comprising an array of field emitter elements; and spacing means for maintaining said anode plate and electron source plate in spaced relationship to one another, said spacing means comprising a planar matrix support structure of intersecting elongate members, which define a plurality of individual cells therebetween, said matrix support structure being formed as a unitary spacer structure having spacer elements integrally mounted to and extending perpendicularly from the planar support structure at points of intersection of the intersecting elongate members and interposed in bearing and supporting relationship between said anode and electron source plates, said individual cells defining pixel regions of the display screen, and wherein said spacer elements have been formed of photoreactive material which has been selectively shaped by preferential etching of the material and coated with an insulative layer for charge leakage control.

* * * * *